United States Patent [19]

Edmo et al.

[11] Patent Number: 4,577,821

[45] Date of Patent: Mar. 25, 1986

[54] LIFTING TABLE

[75] Inventors: Torbjörn Edmo, Härnösand; Per-Olof Sehlstedt, Ålandsbro, both of Sweden

[73] Assignee: Torbjörn Edmo AB, Härnösand, Sweden

[21] Appl. No.: 641,307

[22] Filed: Aug. 14, 1984

[30] Foreign Application Priority Data

Aug. 29, 1984 [SE] Sweden ..... 8304655

[51] Int. Cl.[4] ..... B66F 3/22

[52] U.S. Cl. ..... 248/421; 187/18; 108/145

[58] Field of Search ..... 248/421, 397, 588, 421; 182/69; 187/18; 108/145

[56] References Cited

U.S. PATENT DOCUMENTS 2,706,102 4/1955 Cresci .
2,862,689 12/1958 Dalrymple et al. .
2,937,852 5/1960 Clarke .

FOREIGN PATENT DOCUMENTS 17914 10/1980 European Pat. Off. ..... 248/421
1756270 3/1970 Fed. Rep. of Germany .
2359326 6/1975 Fed. Rep. of Germany ..... 248/575
1169210 12/1958 France .
1343743 10/1963 France .
846161 11/1958 United Kingdom .

*Primary Examiner*—Reinaldo P. Machado
*Assistant Examiner*—Alvin Chin-Shue
*Attorney, Agent, or Firm*—Spencer & Frank

[57] ABSTRACT

A lifting table comprises at least two pairs of scissor arms pivotally interconnected by means of joints and adapted to cooperate in raising and lowering a table in relation to an underlying base portion by means of at least one longitudinally extensible power transmission device, for example a hydraulic cylinder. A carrier member coupled with the power transmission device transversely of the longitudinal direction thereof, is inserted through an oblong hole in a first scissor arm and adapted to cooperate with a sloping slideway on the second scissor arm, said slideway being adapted, on displacement of the carrier member from an initial position in which the scissor arms are in one plane, to provide a lifting of at least the first scissor arm into a position in which a substantial moment arm has been established between the carrier member and the joint between the scissor arms.

6 Claims, 3 Drawing Figures

LIFTING TABLE

TECHNICAL FIELD OF THE INVENTION

The invention relates to a lifting table of the type comprising two pairs of scissor arms, each pair having an inner and an outer arm pivotally interconnected by means of a joint or an axle, and adapted to cooperate in raising and lowering a table or the like in relation to an underlying base portion by means of at least one longitudinally extensible power transmission device, for example a hydraulic cylinder, positioned in the area between the inner scissor arms, the two scissor arm ends extending backwards from the joint being fixedly but hingedly connected to the table and the base portion, respectively, whereas the opposite ends of the arms are movable, for example by rollers or wheels, along the base portion and the table, respectively, and a carrier member coupled with the power transmission device transversely of the longitudinal direction thereof, being inserted through an oblong hole in an inner scissor arm and adapted to cooperate with a sloping slideway on the associated outer scissor arm, said slideway being adapted, on displacement of the carrier member from an initial position in which the scissor arms are in one plane, to swing at least the inner scissor arm into a position in which a substantial moment arm has been established between the carrier member and the joint between the scissor arms.

PRIOR ART

A lifting table of the type generally described above is previously known from FR patent specification No. 1,169,210 which discloses a lifting table comprising two pairs of scissor arms, each pair consisting of an inner arm and an outer arm pivotally interconnected by means of a joint. On the outer scissor arm, a shoulder with a sloping slideway is provided, and the inner arm has an oblong hole for a transverse axle adapted to cooperate with the slideway and coupled with a power transmission device in the form of a hydraulic cylinder Furthermore, the two outer arms extend slightly beyond the inner arms and are interconnected by means of an axle on which the hydraulic cylinder is attached. However, in this known construction, the hydraulic cylinder is extending past the joints such that both the shoulders and the cooperating axle are located beyond the joints, as seen from the stationary end of the cylinder In other words, the joints are located between the axle and the attachment point of the cylinder. The result is a most complicated and, in practice, unreliable connection between the axle and the hydraulic cylinder, implying that the piston rod of the hydraulic cylinder must be connected to a separate, transverse axle which again is connected to both the axle and the pin of the joint, i.e. by way of a link. The parting of the two scissor arms is initiated by applying traction to the axle by means of the hydraulic cylinder, the wheel on the axle acting against the underside of the sloping shoulder.

BRIEF DESCRIPTION OF THE INVENTION

The present invention aims at eliminating the above-mentioned disadvantages and creating a lifting table with a simple and reliable power transmission. This is achieved according to the invention in that the carrier member has the form of a single axle, the two opposite end portions of which protrude through the holes in the two inner scissor arms and which axle is directly coupled with one end of the power transmission device, the opposite end of which is connected to a transverse attachment axle extending between the two outer scissor arms, and in that the carrier axle and consequently said slideways are located between the attachment axle and said joints.

DETAILED DESCRIPTION OF A PREFERRED EMBODIMENT OF THE INVENTION

Figure 1:
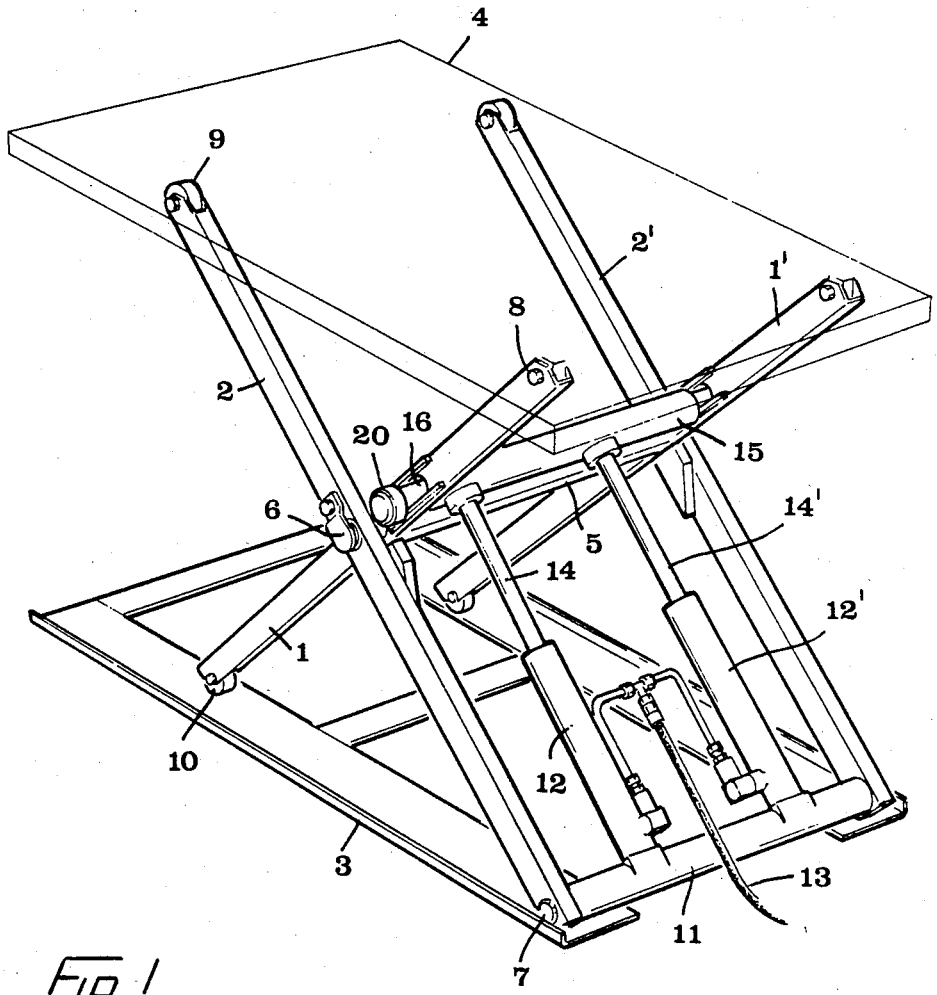
FIG. 1 is a perspective view of the lifting table according to the invention in an active, extended state.

FIG. 1 shows that the construction according to the invention comprises two pairs of scissor arms, a first or inner scissor arm of each pair being designated 1 and 1', and a second or outer scissor arm being designated 2 and 2'. The two pairs of scissor arms are arranged on a common base portion generally designated 3 and jointly support a table, in its entirety designated 4. Although this table is shown, for the sake of simplicity, as a simple, rectangular plate, it is understood that the table may have any optional shape and may generally serve as an arbitrary type of load carrier. Between the two pairs of scissor arms, a spacer tube 5 is arranged whose opposite ends are provided with joints 6 mutually connecting the two arms 1, 2; 1', 2' of each pair. Around these joints the arms are pivotable relatively to each other. As indicated in FIG. 3, the joints 6 may either consist of simple pivot pins, or, alternatively, consist of a through axle extending through the tube 5.

The two ends of the scissor arms 1, 2 extending backwards from the joint 6 (to the right in FIG. 1) are fixedly but hingedly connected to the base portion 3 and the table 4 by joints 7 and 8, respectively. At the opposite end of the arms, wheels or rollers 9 and 10, respectively, are provided to engage the underside of the table 4 and the top side of the base portion 3. In the area of the joint 7, the scissor arm 2 is connected to the arm 2' by means of a further spacer tube 11 with which two power transmission devices 12, 12' are coupled which preferably are in the form of double-acting hydraulic cylinders supplied with pressure medium via a hose pipe 13. The movable piston rods 14, 14' of these cylinders are connected at their free ends to a carrier member 15 in the form of a tube, extending transversely to the direction of motion of the piston rods.

Figure 2:
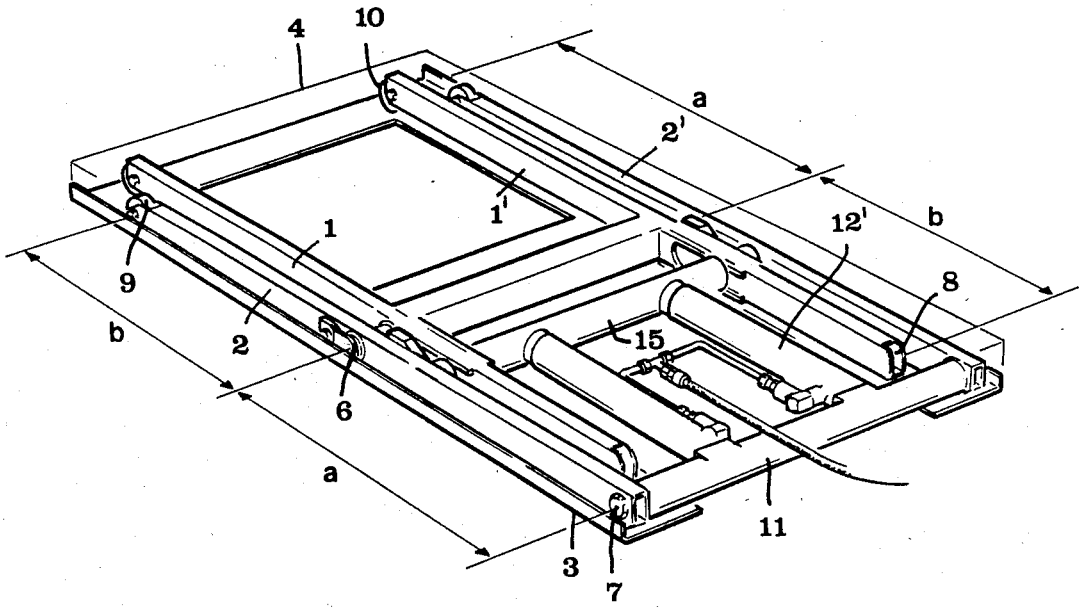
FIG. 2 is a perspective view of the same construction in a folded state.

FIG. 2 shows that the distance "a" between the wheels 10 of the two inner scissor arms and the joint 6 is equal to the distance between the two joints 6 and 7 along the outer scissor arms. The distance "b" between the joint 6 and the joints 8 of the inner scissor arms is, however, smaller than the distance "a", like the distance between the joint 6 and the wheels 9 of the outer scissor arms. In this manner, when the lifting table is in the folded position shown in FIG. 2, room is provided for the arms 1, 1' on the inner side of the tube 11 serving as an attachment axle for the cylinders 12.

Figure 3:
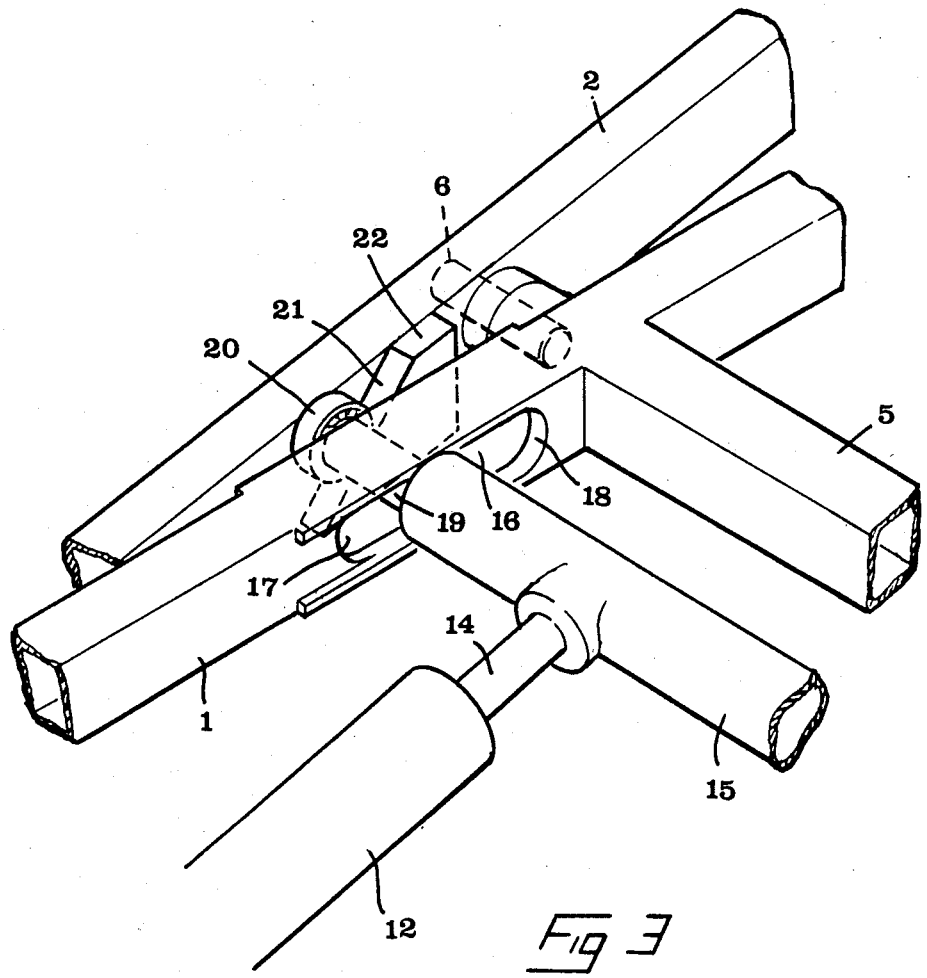
FIG. 3 is an enlarged view of a part of the construction when the lifting is initiated from the state shown in FIG. 2 into the state shown in FIG. 1.

As will appear from FIG. 3, each inner scissor arm 1, 1' has an oblong hole 16 with rear and front ends 17, 18. At the end of the tube 15 adjacent the arm 1, a pin 19 is inserted and rotatably mounted in the tube 15 and having, at its free end, a ring or a roller 20 which again is rotatably mounted on the pin. When lifting is initiated, the roller 20 is adapted to engage with a slideway sloping in relation to the longitudinal extent of the outer arm 2, 2' and formed on a shoulder 22 mounted on the inside of the arm 2, 2'.

Function of the lifting table according to the invention

In the inactive folded state shown in FIG. 2, the scissor arms 1, 1', 2, 2' are positioned in one plane, thus ensuring an extremely small total height of the construction. In this position, the pins 19 are located at the rear ends 17 of the holes 16 of the scissor arms 1, 1', implying that the rollers 20 are in the area of the rear ends of the slideways 21. For lifting the table 4, the piston rods 14, 14' are moved out of the cylinders 12, 12' such that the carrier member or tube 15 is caused to move in the direction away from the rear ends of the holes 16 in the arms 1, 1' towards the front ends 18 thereof. The rollers 20 now come into contact with the slideways 21 of the two outer scissor arms 2, 2', implying that the rollers 20 and thus the tube 15 in its entirety begin to rise from the base portion 3. As the rollers are rising, the pins 19 will lift the two inner scissor arms 1, 1' since the pins abut against the upper side of the holes 16. The upward movement causes the free ends of the arms 1, 1' to pivot on the rollers 10; this again causes the pivot pins 6 and also the shoulders 22 on the outer scissor arms 2, 2' to rise in relation to the base portion. Therefore, when the rollers 20 have moved along the entire length of the slideways 21 and the pins 19 have reached the front ends 18 of the holes 16 in the scissor arms 1, 1', a moment arm has been established between on one hand the center axle through the tube 15 and, on the other hand, the axle constituted by the joints 6, the force of said moment arm being sufficient to make continued movement of the piston rods 14, 14' out of the cylinders swing the scissor arms around the joints 6 into the extended position, shown in, for example, FIG. 1.

Advantages of the Invention

Since the carrier member shown is inserted through an oblong hole in each inner scissor arm and adapted to cooperate with a sloping slideway in the manner described, the entire construction may be given a total height substantially determined by the width or thickness of the scissor arms. In other words, the construction may be given the absolutely minimum total height. Furthermore, the power transmission between the hydraulic cylinders 12, 12' and the two pairs of scissor arms 1, 2 and 1', 2' is extremely simple since the tube 15 serving as a carrier axle is located between the attachment axle 11 and the joints 6 or the axis constitued thereby. Thus, when lifting the table, the cylinders 12, 12' can operate by compression instead of traction, which is the case in FR patent specification No. 1,169,210.

Possible modifications of the invention

The invention is, of course, not limited merely to the embodiment described above and shown in the drawings. Thus, instead of hydraulic cylinders, other types of power transmission devices can be used, for example screw mechanisms of a suitable type. Although two power transmission devices are shown in the drawings, in practice one such device only will also be sufficient. Furthermore, the term "base portion" should be interpreted in its widest sense. Thus, the base portion need not be included in the construction already at delivery, since the scissor arms 2, 2' may be hingedly connected to an optional base portion, for example a simple floor or a foundation. Instead of the straight slideway as shown, curved slideways may be used to provide a progressively increasing lifting movement. The construction shown need not be stationary, but may be included in a mobile unit, for example a carriage.

What I claim and desire to secure by Letters Patent is:

1. Lifting table comprising two pairs of scissor arms, each pair having an inner arm and an outer arm pivotally interconnected by means of a joint or an axle and adapted to cooperate in raising and lowering a table or the like in relation to an underlying base portion by means of at least one longitudinally extensible power transmission device, for example a hydraulic cylinder, positioned in the area between the inner scissor arms, the scissor arms having ends which extend backwards from the joint and which are fixedly but hingedly connected to the table and the base portion, respectively, whereas the opposite ends of the arms are movable, for example by rollers or wheels, along the base portion and the table, respectively, and a carrier member, coupled with the power transmission device transversely of the longitudinal direction thereof, being inserted through an oblong hole in an inner scissor arm and adapted to cooperate with a sloping slideway on the associated outer scissor arm, said slideway being adapted, on displacement of the carrier member from an initial position in which the scissor arms are in one plane, to swing at least the inner scissor arm into a position in which a substantial moment arm has been established between the carrier member and the joint between the scissor arms, wherein the carrier member has the form of a single axle, the two opposite end portions of which protrude through the holes in the two inner scissor arms and which axle is directly coupled with one end of the power transmission device the opposite end of which is connected to a transverse attachment axle extending between the two outer scissor arms, wherein the carrier axle and consequently said slideways are located between the attachment axle and said joints, and wherein the carrier axle includes at least one rotatably mounted pin protruding through the oblong holes and roller-shaped portions that are rotatably mounted on said at least one pin and that are positioned to engage the slideways.

2. A lifting table, comprising:

a base portion having a first end and a second end;

a table having a first end that is oriented toward the first end of said base portion and having a second end that is oriented toward the second end of said base portion;

a pair of outer scissor arms that are disposed between said table and said base portion, each outer scissor arm having a first end, a second end, and a predetermined intermediate position that is located between its first and second ends;

means for fixedly but hingedly mounting the first ends of said outer scissor arms to said base portion at spaced apart positions adjacent the first end of said base portion;

a pair of inner scissor arms that are disposed between said table and said base portion, each inner scissor arm having a first end, a second end, and a predetermined intermediate position located between its first and second ends, each inner scissor arm additionally having an oblong hole between its intermediate position and first end;

means for fixedly but hingedly mounting the first ends of said inner scissor arms to said table at spaced apart positions adjacent the first end of said table, each inner scissor arm being disposed between said outer scissor arms and adjacent a respective one of said outer scissor arms;

joint means for rotatably connecting each inner scissor arm, at the intermediate position thereof, to its respective outer scissor arm, at the intermediate position thereof;

means at the second ends of said outer scissor arms for movably contacting said table;

means at the second ends of said inner scissor arms for movably contacting said base portion;

a pair of shoulders having slideways, said shoulders being disposed between said outer scissor arms, with each shoulder being affixed to a respective outer scissor arm at a position between the first end thereof and the intermediate position thereof;

an elongated carrier member positioned between the inner scissor arms;

at least one pin extending through the oblong holes of said inner scissor arms, said at least one pin being mounted on said carrier member and being rotatable with respect thereto;

a pair of rollers positioned to engage said slideways, said rollers being mounted on said at least one pin and being rotatable with respect thereto; and power transmission means for forcing said carrier member away from the first end of said base portion, so that said inner scissor arms are rotated with respect to said outer scissor arms when said rollers are urged against said slideways, thereby displacing said carrier member with respect to said joint means to create a substantial movement arm.

3. The lifting table of claim 2, further comprising a spacer tube mounted between the first ends of said inner scissor arms, and wherein said power transmission means comprises hydraulic cylinder means for controlling the distance between said spacer tube and said carrier member, said hydraulic cylinder means being disposed between said outer scissor arms.

4. The lifting table of claim 3, wherein said hydraulic cylinder means comprises a pair of double-acting hydraulic cylinders.

5. The lifting table of claim 2, wherein said means at the second ends of said outer scissor arms comprise rollers and said means at the second ends of said inner scissor arms comprise rollers.

6. The lifting table of claim 5, wherein the distance between the first ends of said outer scissor arms and said joint means is greater than the distance between the first ends of said inner scissor arms and said joint means and wherein the distance between the second ends of said inner scissor arms and said joint means is greater than the distance between the second ends of said outer scissor arms and said joint means.

* * * * *